US007263817B1

(12) United States Patent
Smith

(10) Patent No.: US 7,263,817 B1
(45) Date of Patent: Sep. 4, 2007

(54) STIRRUP EXTENSION DEVICE AND METHOD

(76) Inventor: Jonathan L. Smith, 33 W. 480 Ashley La., Wayne, IL (US) 60184

( * ) Notice: Subject to any disclaimer, the term of this patent is extended or adjusted under 35 U.S.C. 154(b) by 121 days.

(21) Appl. No.: 11/112,560

(22) Filed: Apr. 25, 2005

(51) Int. Cl.
*B68B 3/00* (2006.01)

(52) U.S. Cl. ..... 54/47

(58) Field of Classification Search ..... 54/46.1, 54/47, 48, 49; D30/142
See application file for complete search history.

(56) References Cited

U.S. PATENT DOCUMENTS

| | | | | |
|---|---|---|---|---|
| 313,609 | A | 3/1885 | Nolon | |
| 3,816,974 | A * | 6/1974 | Erickson | D30/142 |
| D279,036 | S | 5/1985 | Ludwig | |
| 4,761,938 | A | 8/1988 | Townsend | |
| 5,347,797 | A * | 9/1994 | Seal et al. | 54/46.1 |
| 5,661,957 | A | 9/1997 | Daly | |
| 5,809,754 | A * | 9/1998 | Schulte | 54/47 |
| 6,173,558 | B1 | 1/2001 | Burke, Jr. | |
| 6,688,088 | B1 * | 2/2004 | Aweeka, Jr. | 54/46.1 |
| 2005/0120684 | A1 * | 6/2005 | Sparacino | 54/46.1 |

* cited by examiner

*Primary Examiner*—Thomas Price

(57) ABSTRACT

A stirrup extension device includes a saddle having a primary stirrup attached thereto and extending downwardly from the saddle. A strap has a first end, a second end, a first side and a second side. A coupler is attached to the first end of the strap. The coupler is removably attachable to the primary stirrup. A secondary stirrup is attached to the second end of the strap. The coupler is coupled to the primary stirrup.

12 Claims, 1 Drawing Sheet

STIRRUP EXTENSION DEVICE AND METHOD

BACKGROUND OF THE INVENTION

1. Field of the Invention

The present invention relates to stirrup extension devices and more particularly pertains to a new stirrup extension device for extending the length of a stirrup toward a ground surface to aid a person, particularly a child, in mounting a horse.

2. Description of the Prior Art

The use of stirrup extension devices is known in the prior art. U.S. Pat. No. 4,761,938 describes a device for extending the length of a stirrup. Another type of stirrup extension device is U.S. Pat. No. 5,661,957 having a structure adapted for selectively lengthening a stirrup toward a ground surface. Still yet another such device is found in U.S. Pat. No. 5,347,797.

While these devices fulfill their respective, particular objectives and requirements, the need remains for a device that allows a stirrup to be lengthened toward a ground surface so that a short person or a child may easily mount a saddle positioned on a horse or pony. The device should be able to be readily retrofitted to an existing stirrup with little or no adjustments. Additionally, the device should have a structure such that it is properly aligned with a stirrup attached to a saddle to ensure its easy usage.

SUMMARY OF THE INVENTION

The present invention meets the needs presented above by generally comprising a saddle having a primary stirrup attached thereto and extending downwardly from the saddle. A strap has a first end, a second end, a first side and a second side. A coupler is attached to the first end of the strap. The coupler is removably attachable to the primary stirrup. A secondary stirrup is attached to the second end of the strap. The coupler is coupled to the primary stirrup.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
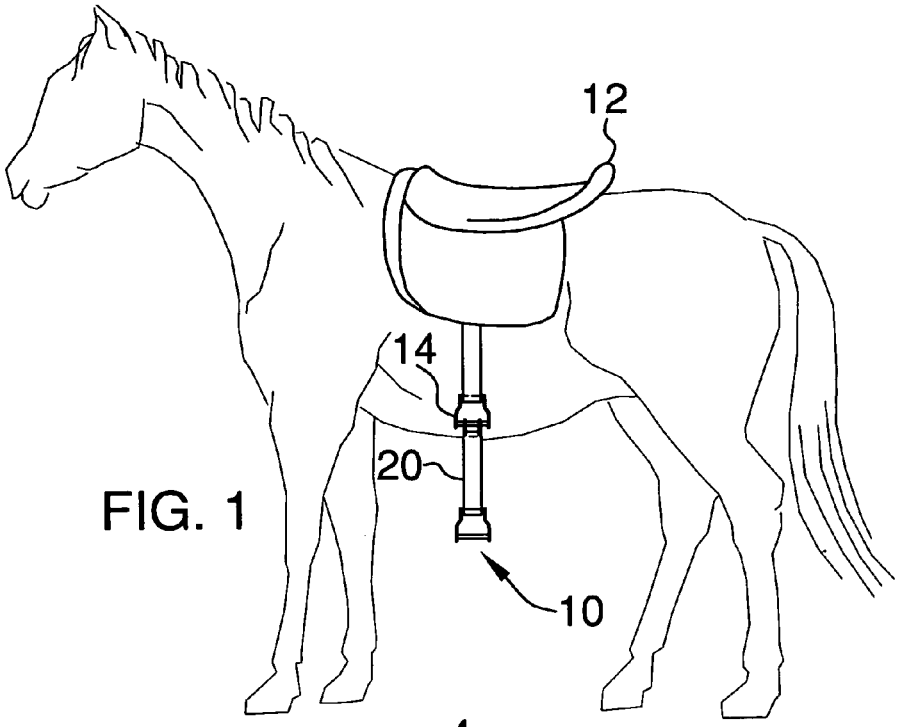
FIG. 1 is a front in-use view of a stirrup extension device and method according to the present invention.
Figure 2:
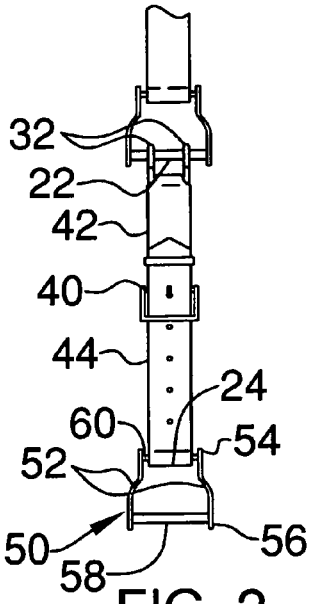
FIG. 2 is a front view of a first embodiment of the present invention.
Figure 3:
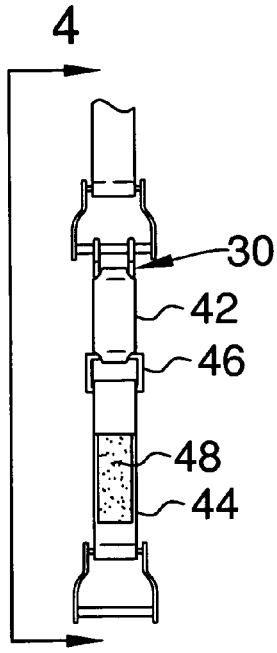
FIG. 3 is a front view of a second embodiment of the present invention.
Figure 4:
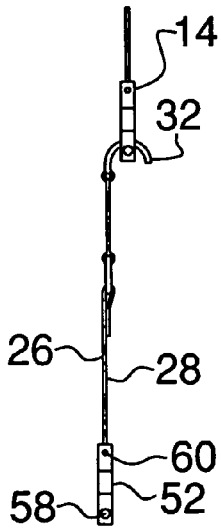
FIG. 4 is a side view taken along line 4—4 of FIG. 3 of the present invention.

With reference now to the drawings, and in particular to FIGS. 1 through 4 thereof, a new stirrup extension device embodying the principles and concepts of the present invention and generally designated by the reference numeral 10 will be described.

As best illustrated in FIGS. 1 through 4, the stirrup extension device and method 10 generally includes providing a conventional saddle 12 and a primary stirrup 14 that is attached to and extends downwardly from the saddle 12.

A strap 20 has a first end 22, a second end 24, a first side 26 and a second side 28. A coupler 30 is attached to the first end 22 of the strap 20. The coupler 30 is removably attachable to the primary stirrup 14. The coupler 30 includes a pair of hooks 32. The hooks 32 are spaced from each other and each of the hooks 32 extends upwardly from the first end 22 and curves away from the first side 26 of the strap 20. The strap 20 has a length generally between 8 inches and 24 inches. The length of the strap 20 is selectively adjustable. The length may be adjusted with a buckle 40 holding together two portions 42, 44 of the strap 20 or two portions of the strap 20 may be attached together by a loop 46 and one of the portions is selectively adjustable with a hook and loop means 48.

A secondary stirrup 50 is attached to the second end 24 of the strap 20. The secondary stirrup 50 includes a pair of vertical supports 52 each having an upper end 54 and a lower end 56. A horizontal support 58 is attached to and extends between the lower ends 56. A rod 60 is attached to and extends between the upper ends 54. The rod 60 is attached to and extends along the second end 24 of the strap 20. The rod 60 and hooks 32 ensure that the secondary stirrup 50 is aligned with the primary stirrup 14.

In use, the coupler 30 is coupled to the primary stirrup 14 so that the strap 20 extends downwardly from the primary stirrup 14. The length of the strap 20 may then be adjusted so that it allows a person of shorter stature, such as a child, to more easily mount the horse.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of extending the length of a stirrup comprising the steps of:

providing a saddle, a primary stirrup being attached to and extending downwardly from said saddle;

providing a strap having a first end, a second end, a first side and a second side, a coupler being attached to said first end of said strap, said coupler being removably attachable to said primary stirrup;

providing a secondary stirrup being attached to said second end of said strap; and coupling said coupler to said primary stirrup, said coupler including a pair of hooks, said hooks being spaced from each other.

2. The method according to claim 1, wherein each of said hooks extends upwardly from said first end and curves away from said first side of said strap.

3. The method according to claim 2, wherein said secondary stirrup includes a pair of vertical supports each having an upper end and a lower end and a horizontal support being attached to and extending between said lower ends, a rod being attached to and extending between said upper ends, said rod being attached to and extending along said second end of said strap.

4. The method according to claim 1, wherein said strap has a length generally between 8 inches and 24 inches.

5. The method according to claim 4, wherein said length of said strap is selectively adjustable.

6. The method according to claim 1, wherein said secondary stirrup includes a pair of vertical supports each having an upper end and a lower end and a horizontal support being attached to and extending between said lower ends, a rod being attached to and extending between said upper ends, said rod being attached to and extending along said second end of said strap.

7. A method of extending the length of a stirrup comprising the steps of:

providing a saddle, a primary stirrup being attached to and extending downwardly from said saddle;

providing a strap having a first end, a second end, a first side and a second side, a coupler being attached to said first end of said strap, said coupler being removably attachable to said primary stirrup, said coupler including a pair of hooks, said hooks being spaced from each other, each of said hooks extending upwardly from said first end and curving away from said first side of said strap, said strap having a length generally between 8 inches and 24 inches, said length of said strap being selectively adjustable;

providing a secondary stirrup being attached to said second end of said strap, said secondary stirrup including a pair of vertical supports each having an upper end and a lower end and a horizontal support being attached to and extending between said lower ends, a rod being attached to and extending between said upper ends, said rod being attached to and extending along said second end of said strap; and coupling said coupler to said primary stirrup and adjusting said length of said strap.

8. A method of extending the length of a stirrup comprising the steps of:

providing a saddle, a primary stirrup being attached to and extending downwardly from said saddle;

providing a strap having a first end, a second end, a first side and a second side, a coupler being attached to said first end of said strap, said coupler being removably attachable to said primary stirrup;

providing a secondary stirrup being attached to said second end of said strap, said secondary stirrup includes a pair of vertical supports each having an upper end and a lower end and a horizontal support being attached to and extending between said lower ends, a rod being attached to and extending between said upper ends, said rod being attached to and extending along said second end of said strap; and coupling said coupler to said primary stirrup.

9. The method according to claim 8, wherein said coupler includes a pair of hooks, said hooks being spaced from each other.

10. The method according to claim 9, wherein each of said hooks extends upwardly from said first end and curves away from said first side of said strap.

11. The method according to claim 8, wherein said strap has a length generally between 8 inches and 24 inches.

12. The method according to claim 11, wherein said length of said strap is selectively adjustable.

* * * * *